US012680211B2

(12) United States Patent
Ewing

(10) Patent No.: US 12,680,211 B2
(45) Date of Patent: Jul. 14, 2026

(54) SYSTEMS AND METHODS FOR DETECTING A DRAIN STANDPIPE HEIGHT FOR A WASHING MACHINE APPLIANCE

(71) Applicant: Haier US Appliance Solutions, Inc., Wilmington, DE (US)

(72) Inventor: Cody Ewing, Floyds Knobs, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 10 days.

(21) Appl. No.: 18/636,943

(22) Filed: Apr. 16, 2024

(65) Prior Publication Data

US 2025/0320649 A1 Oct. 16, 2025

(51) Int. Cl.

| | |
|---|---|
| ***D06F 34/20*** | (2020.01) |
| ***D06F 33/42*** | (2020.01) |
| ***D06F 34/28*** | (2020.01) |
| ***D06F 39/08*** | (2006.01) |
| *D06F 103/14* | (2020.01) |
| *D06F 105/08* | (2020.01) |
| *D06F 105/58* | (2020.01) |

(52) U.S. Cl.

CPC ..... *D06F 34/20* (2020.02); *D06F 33/42* (2020.02); *D06F 34/28* (2020.02); *D06F 39/085* (2013.01); *D06F 2103/14* (2020.02); *D06F 2105/08* (2020.02); *D06F 2105/58* (2020.02)

(58) Field of Classification Search

CPC ..... D06F 2105/58; D06F 2105/08; D06F 2103/14; D06F 33/42; D06F 34/20

See application file for complete search history.

(56) References Cited

U.S. PATENT DOCUMENTS

| | | | | |
|---|---|---|---|---|
| 11,035,071 | B2 | 6/2021 | Damtew | |
| 11,530,505 | B2 | 12/2022 | Scheckelhoff et al. | |
| 2007/0113595 | A1* | 5/2007 | Harwood | D06F 39/087 68/12.01 |
| 2010/0236001 | A1* | 9/2010 | Lee | D06F 33/38 8/159 |

FOREIGN PATENT DOCUMENTS

| | | | |
|---|---|---|---|
| CA | 2697330 | C | 10/2012 |
| CN | 112760911 | B | 1/2022 |
| CN | 115852631 | A | 3/2023 |

* cited by examiner

*Primary Examiner* — Katelyn W Smith

(74) *Attorney, Agent, or Firm* — Dority & Manning, P.A.

(57) ABSTRACT

A method for operating a washing machine appliance may include initializing an operating cycle of the washing machine appliance. The method may include activating a pump assembly to flow a first predetermined depth of water from a tub to a drain standpipe following initializing the operating cycle. The method may include calculating a first drain rate following activating the pump assembly to flow the first predetermined depth of water. The method may include activating the pump assembly to flow a second predetermined depth of water from the tub to the drain standpipe following calculating the first drain rate. The method may include calculating a second drain rate following activating the pump assembly to flow the second predetermined depth of water. The method may include determining a height of the drain standpipe based on the first drain rate and the second drain rate.

20 Claims, 4 Drawing Sheets

SYSTEMS AND METHODS FOR DETECTING A DRAIN STANDPIPE HEIGHT FOR A WASHING MACHINE APPLIANCE

FIELD OF THE DISCLOSURE

The present subject matter relates generally to a washing machine appliance and more particularly to a washing machine appliance that utilizes a drain standpipe.

BACKGROUND OF THE DISCLOSURE

Washing machine appliances generally include a wash tub for containing water or wash fluid (e.g., water, detergent, bleach, or other wash additives). A basket is rotatably mounted within the wash tub and defines a wash chamber for receipt of articles for washing. During normal operation of such washing machine appliances, the wash fluid is directed into the wash tub and onto articles within the wash chamber of the basket. The basket or an agitation element may rotate at various speeds to agitate articles within the wash chamber, to wring wash fluid from articles within the wash chamber, etc.

Often, washing machine appliances need to drain wash fluid to a drain standpipe that is a component of a building housing the washing machine appliance. A height of the drain standpipe varies between buildings. The height of the drain standpipe is normally between about three feet (3') to about five feet (5'). However, in certain buildings, the height of the drain standpipe can be higher or lower than the normal height. For example, in some buildings, the height of the drain standpipe can be lower than three feet, such as two and a half feet (2'5") or less, or higher than five feet, such as eight feet (8') or more.

Drain standpipes that are too high or too low pose challenges. For example drain standpipes that are too low can result in the undesired siphoning of wash fluid out of the machine, for instance, after draining has stopped. Thus, wash fluid levels can be too low to effectively clean articles. As another example, drain standpipes that are too high can result in a pump assembly that does not have sufficient time or capacity to fully drain the tub, then wash water can remain with a sump of the tub. Such wash water can negatively affect rotation of a basket within the tub or generate an undesirable soap suds condition within the tub.

Accordingly, a washing machine appliance that obviates one or more of the above challenges would be beneficial.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a method for operating a washing machine appliance is provided. The washing machine appliance may include a tub, a basket within the tub and a pump assembly operable to flow wash fluid from the tub. The method may include initializing an operating cycle of the washing machine appliance. The method may also include activating the pump assembly to flow a first predetermined depth of water from the tub to a drain standpipe following initializing the operating cycle of the washing machine appliance. The method may also include calculating a first drain rate following activating the pump assembly to flow the first predetermined depth of water from the tub to the drain standpipe. The method may also include activating the pump assembly to flow a second predetermined depth of water from the tub to the drain standpipe following calculating the first drain rate. The method may also include calculating a second drain rate following activating the pump assembly to flow the second predetermined depth of water from the tub to the drain standpipe. The method may further include determining a height of the drain standpipe based on the first drain rate and the second drain rate.

In another exemplary aspect of the present disclosure, a washing machine appliance is provided. The washing machine appliance may include a tub. The washing machine appliance may include a basket within the tub. The washing machine appliance may include a pump assembly operable to flow wash fluid from the tub. The washing machine appliance may include a controller in operative communication with the pump assembly. The controller may be operable for initializing an operating cycle of the washing machine appliance; activating the pump assembly to flow a first predetermined depth of water from the tub to a drain standpipe following initializing the operating cycle of the washing machine appliance; calculating a first drain rate following activating the pump assembly to flow the first predetermined depth of water from the tub to the drain standpipe; activating the pump assembly to flow a second predetermined depth of water from the tub to the drain standpipe following calculating the first drain rate; calculating a second drain rate following activating the pump assembly to flow the second predetermined depth of water from the tub to the drain standpipe; and determining a height of the drain standpipe based on the first drain rate and the second drain rate.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
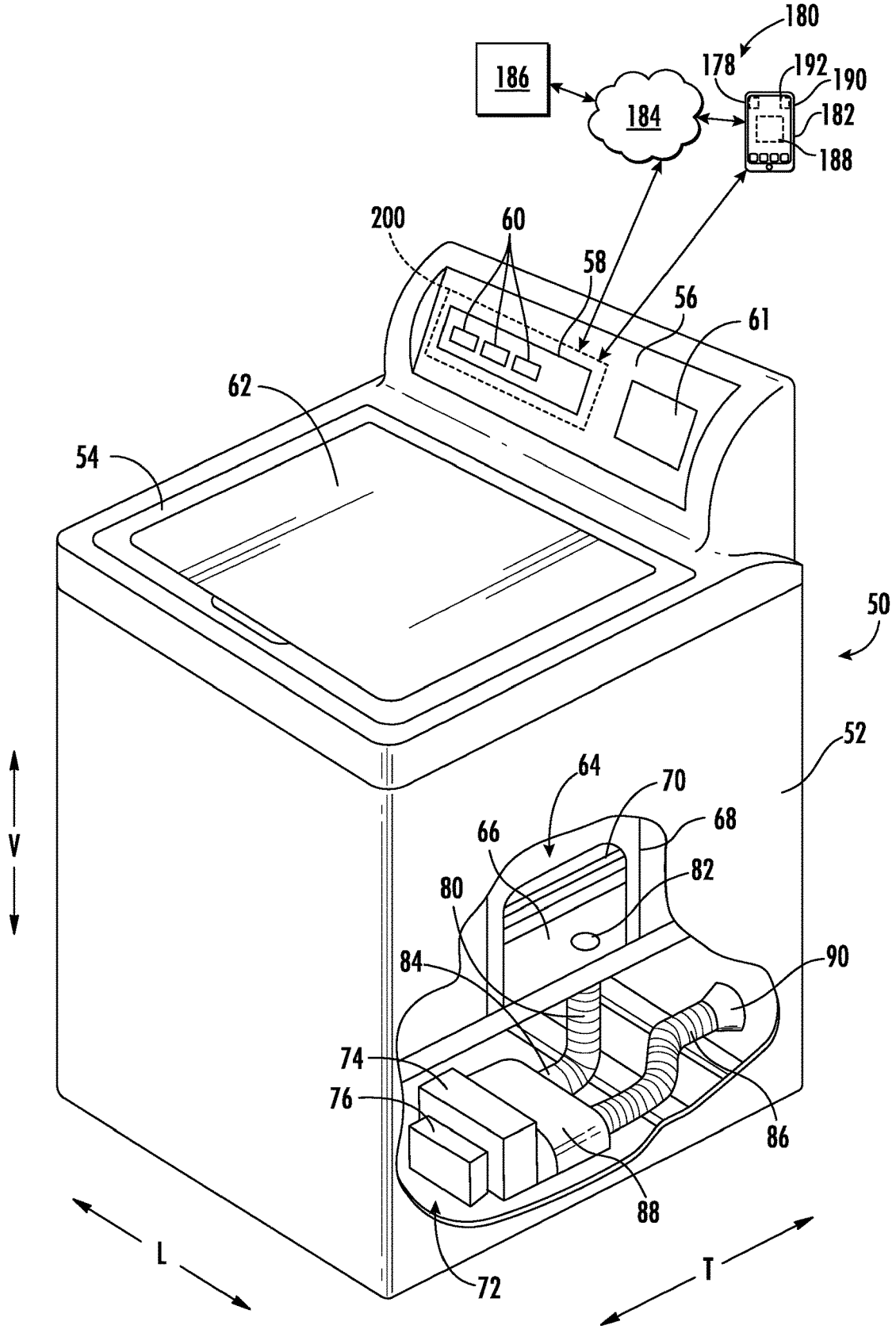
FIG. 1 is a perspective view of a washing machine appliance according to one or more exemplary embodiments of the present subject.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations.

Except as explicitly indicated otherwise, recitation of a singular processing element (e.g., "a controller," "a processor," "a microprocessor," etc.) is understood to include more than one processing element. In other words, "a processing element" is generally understood as "one or more processing element." Furthermore, barring a specific statement to the contrary, any steps or functions recited as being performed by "the processing element" or "said processing element" are generally understood to be capable of being performed by "any one of the one or more processing elements." Thus, a first step or function performed by "the processing element" may be performed by "any one of the one or more processing elements," and a second step or function performed by "the processing element" may be performed by "any one of the one or more processing elements and not necessarily by the same one of the one or more processing elements by which the first step or function is performed." Moreover, it is understood that recitation of "the processing element" or "said processing element" performing a plurality of steps or functions does not require that at least one discrete processing element be capable of performing each one of the plurality of steps or functions.

As used herein, the terms "clothing," "articles," and the like may include but need not be limited to fabrics, textiles, garments, linens, papers, or other items which may be cleaned, dried, or otherwise treated in a laundry appliance. Furthermore, the terms "load" or "laundry load" refers to the combination of clothing that may be washed together in a washing machine or dried together in a dryer appliance and may include a mixture of different or similar articles of clothing of different or similar types and kinds of fabrics, textiles, garments and linens within a particular laundering process.

The terms "wash fluid" and the like may be used herein to generally refer to a liquid used for washing or rinsing clothing or other articles. For example, the wash fluid is typically made up of water that may include other additives such as detergent, fabric softener, bleach, or other suitable treatments (including combinations thereof).

FIG. 1 provides a perspective view of a washing machine appliance 50 with a partially removed layer according to an example embodiment of the present subject matter. As may be seen in FIG. 1, washing machine appliance 50 defines a vertical direction V, a lateral direction L and a transverse direction T. The vertical direction V, lateral direction L and transverse direction T are mutually perpendicular and form an orthogonal direction system.

Washing machine appliance 50 may generally include a cabinet or apron 52 and a top panel or cover 54. A backsplash 56 may extend from cover 54, and a control panel 58 including a plurality of input selectors 60 may be coupled to backsplash 56. Control panel 58 and input selectors 60 may collectively form a user interface input for operator selection of machine cycles and features, and in one embodiment a display 61 may indicate selected features, a countdown timer, or other items of interest to machine users. A lid 62 may be mounted to cover 54 and is rotatable about a hinge (not shown) between an open position (not shown) facilitating access to a wash tub 64 located within apron 52, and a closed position (shown in FIG. 1) forming a sealed enclosure over wash tub 64.

As illustrated in FIG. 1, washing machine appliance 50 is a vertical axis washing machine appliance. While the present disclosure is discussed with reference to a vertical axis washing machine appliance, those of ordinary skill in the art, using the disclosures provided herein, should understand that the subject matter of the present disclosure is equally applicable to other washing machine appliances, such as horizontal axis washing machine appliances.

A sub-washer unit 65 (FIG. 2) is mounted within apron 52. Sub-washer unit 65 includes tub 64 and a basket 70. Tub 64 includes a bottom wall 66 and a cylindrical side wall 68. Basket 70 may be rotatably mounted within wash tub 64. Bottom wall 66 of tub 64 is spaced, e.g., vertically, from an open top end of cylindrical side wall 68. A pump assembly 72, such as a drain pump assembly, is located beneath tub 64 and basket 70 for gravity assisted flow when draining tub 64. Pump assembly 72 includes a pump 74, such as drain pump, and a motor 76. A pump inlet hose 80 extends from a wash tub outlet 82 in tub bottom wall 66 to a pump inlet 84, and a drain hose 86 extends from a pump outlet 88 and ultimately to a building plumbing system discharge line (not shown) in flow communication with drain hose 86.

Figure 3:
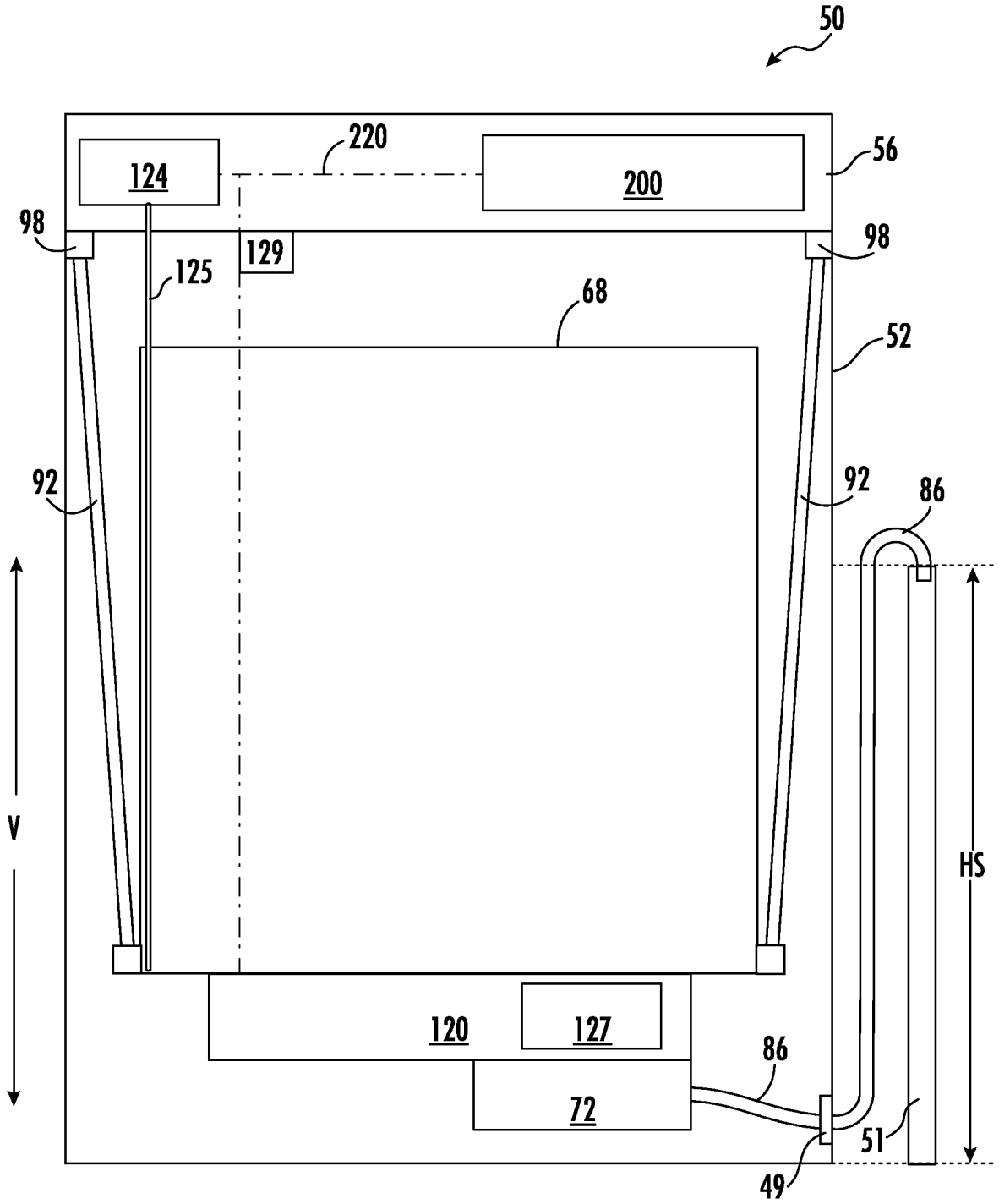
FIG. 3 is a schematic view of certain components of the exemplary washing machine appliance of FIG. 1.

As shown in FIG. 3, pump assembly 72 may be mounted to tub 64 in alternative example embodiments. In particular, pump assembly 72 may be mounted directly to the bottom side of sub-washer unit 65. Wash fluid may drain under gravity from tub 64 or may be pumped out of appliance 50 via pump assembly 72. The displaced wash fluid passes through drain hose 86, which may have a discharge end attached to a rear panel mounted bracket 49, during operation of pump assembly 72.

Figure 2:
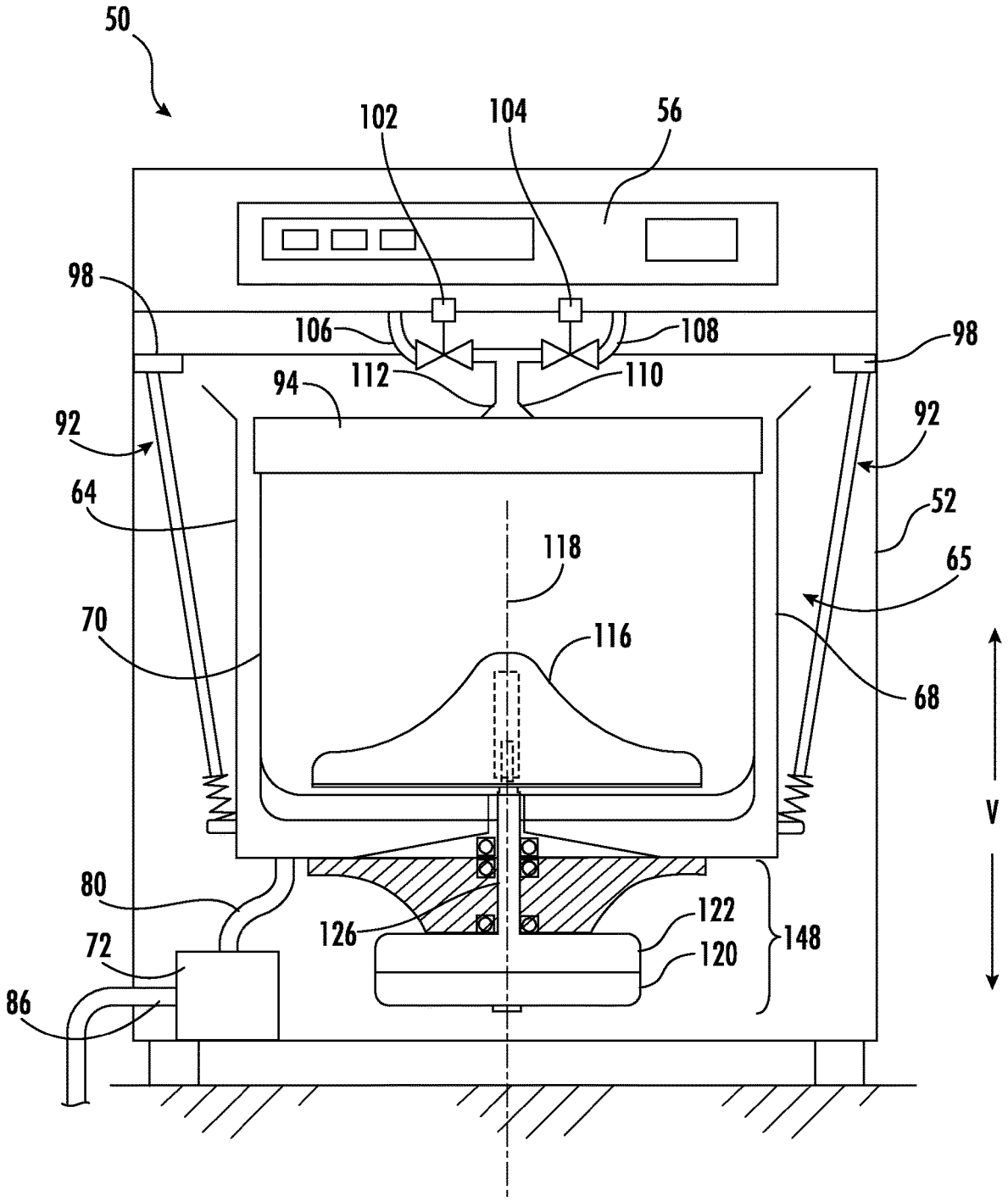
FIG. 2 is a section view of the exemplary washing machine appliance of FIG. 1.

FIG. 2 provides a front elevation schematic view of certain components washing machine appliance 50 including wash basket 70 movably disposed and rotatably mounted in wash tub 64 in a spaced apart relationship from tub side wall 68 and tub bottom 66. Basket 70 includes a plurality of perforations therein to facilitate fluid communication between an interior of basket 70 and wash tub 64.

A hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 together form a liquid supply connection for washing machine appliance 50 and, when connected to a building plumbing system (not shown), provide a fresh water supply for use in washing machine appliance 50. Liquid valves 102, 104 and liquid hoses 106, 108 are connected to a basket inlet tube 110, and fluid is dispersed from inlet tube 110 through a nozzle assembly 112 having a number of openings therein to direct washing liquid into basket 70 at a given trajectory and velocity. A dispenser (not shown in FIG. 2) may also be provided to produce a wash fluid by mixing fresh water with a known detergent or other composition for cleansing of articles in basket 70.

An agitation element 116, such as a vane agitator, impeller, auger, or oscillatory basket mechanism, or some combination thereof is disposed in basket 70 to impart an oscillatory motion to articles and liquid in basket 70. In various example embodiments, agitation element 116 may be a single action element (oscillatory only), double action (oscillatory movement at one end, single direction rotation at the other end) or triple action (oscillatory movement plus single direction rotation at one end, single direction rotation at the other end). As illustrated in FIG. 2, agitation element 116 is oriented to rotate about a vertical axis 118.

Basket 70 and agitator 116 are driven by a motor 120 through a transmission and clutch system 122. The motor 120 drives shaft 126 to rotate basket 70 within wash tub 64. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120 and transmission and clutch system 122 collectively are referred herein as a motor assembly 148 and may be a component of sub-washer unit 65.

Sub-washer unit 65 further includes a vibration damping suspension system or mount 92 for supporting sub-washer unit 65 within apron 52. One end of mount 92 may be connected to sub-washer unit 65 while an opposite end of mount 92 is receivable within or coupled to at least one bracket 98. Thus, mount 92 may extend between sub-washer unit 65 and bracket 98 in order to suspend sub-washer unit 65 within apron 52.

Mount 92 may include a plurality of damping elements, such as piston-cylinder damping elements, coupled to the wash tub 64. The damping suspension system, mount 92, may include other elements, such as a balance ring 94 disposed around the upper circumferential surface of the wash basket 70. The balance ring 94 may be used to counterbalance an out of balance condition for the wash machine as the basket 70 rotates within the wash tub 64.

In an illustrative embodiment, laundry items are loaded into basket 70, and washing operation is initiated through operator manipulation of control input selectors 60 (shown in FIG. 1). Tub 64 is filled with water and mixed with detergent to form a wash fluid, and basket 70 is agitated with agitation element 116 for cleansing of laundry items in basket 70. That is, agitation element is moved back and forth in an oscillatory back and forth motion. In the illustrated embodiment, agitation element 116 is rotated clockwise a specified amount about the vertical axis of the machine, and then rotated counterclockwise by a specified amount. The clockwise and counterclockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism. After the agitation phase of the wash cycle is completed, tub 64 is drained with pump assembly 72. Laundry items are then rinsed, and portions of the cycle may be repeated, including the agitation phase, depending on the particulars of the wash cycle selected by a user.

As may be seen in FIG. 3, washing machine appliance 50 includes a wash fluid height sensor 124, a controller 200 and a wiring harness 220. Controller 200 is positioned within apron 52, e.g., within backsplash 56. Wiring harness 220 electrically connects controller 200 with one or more electrical components, such as motor 76, motor 120 and wash fluid height sensor 124. Thus, e.g., wiring harness 220 may extend between controller 200 and the one or more electrical components.

Referring again to FIG. 1, washing machine appliance 50 may include control panel 58 that may represent a general-purpose Input/Output ("GPIO") device or functional block for washing machine appliance 50. In some embodiments, control panel 58 may include or be in operative communication with one or more input selectors 60, such as one or more of a variety of digital, analog, electrical, mechanical, or electro-mechanical input devices including rotary dials, control knobs, push buttons, toggle switches, selector switches, and touch pads. Additionally, washing machine appliance 50 may include display 61, such as a digital or analog display device generally configured to provide visual feedback regarding the operation of washing machine appliance 50. For example, display 61 may be provided on control panel 58 and may include one or more status lights, screens, or visible indicators. According to example embodiments, input selectors 60 and display 61 may be integrated into a single device, e.g., including one or more of a touchscreen interface, a capacitive touch panel, a liquid crystal display (LCD), a plasma display panel (PDP), or other informational or interactive displays.

Washing machine appliance 50 may further include or be in operative communication with a processing device or controller 200 that may be generally configured to facilitate appliance operation. In this regard, control panel 58, input selectors 60, and display 61 may be in communication with controller 200 such that controller 200 may receive control inputs from input selectors 60, may display information using display 61, and may otherwise regulate operation of washing machine appliance 50. For example, signals generated by controller 200 may operate washing machine appliance 50, including any or all system components, subsystems, or interconnected devices, in response to the position of input selectors 60 and other control commands. Control panel 58 and other components of washing machine appliance 50 may be in communication with controller 200 via, for example, one or more signal lines or shared communication buses. In this manner, Input/Output ("I/O") signals may be routed between controller 200 and various operational components of washing machine appliance 50.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 200 may be constructed without using a microprocessor, e.g., using a combination of discrete analog or digital logic circuitry (such as switches, amplifiers, integrators, comparators, flip-flops, AND/OR gates, and the like) to perform control functionality instead of relying upon software.

Controller 200 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices may store information or data accessible by one or more processors, including instructions that may be executed by the one or more processors. It should be appreciated that the instructions may be software written in any suitable programming language or may be implemented in hardware. Additionally, or alternatively, the instructions may be executed logically or virtually using separate threads on one or more processors.

For example, controller 200 may be operable to execute programming instructions or micro-control code associated with an operating cycle of washing machine appliance 50. In this regard, the instructions may be software or any set of instructions that when executed by the processing device, cause the processing device to perform operations, such as running one or more software applications, displaying a user interface, receiving user input, processing user input, etc. Moreover, it should be noted that controller 200 as disclosed herein is capable of and may be operable to perform any methods, method steps, or portions of methods as disclosed herein. For example, in some embodiments, methods disclosed herein may be embodied in programming instructions stored in the memory and executed by controller 200.

The memory devices may also store data that may be retrieved, manipulated, created, or stored by one or more processors or portions of controller 200. The data may include, for instance, data to facilitate performance of methods described herein. The data may be stored locally (e.g., on controller 200) in one or more databases or may be split up so that the data is stored in multiple locations. In addition, or alternatively, one or more database(s) may be connected to controller 200 through any suitable network(s), such as through a high bandwidth local area network (LAN) or wide area network (WAN). In this regard, for example, controller 200 may further include a communication module or interface that may be used to communicate with one or more other component(s) of washing machine appliance 50, controller 200, an external device 182 (e.g., device controller 188), or any other suitable device, e.g., via any suitable communication lines or network(s) and using any suitable communication protocol. The communication interface may include any suitable components for interfacing with one or more network(s), including for example, transmitters, receivers, ports, controllers, antennas, or other suitable components.

Referring again to FIG. 1, a schematic diagram of an external communication system 180 will be described according to an example embodiment of the present subject matter. In general, external communication system 180 is configured for permitting interaction, data transfer, and other communications between washing machine appliance 50 and one or more remote external devices. For example, this communication may be used to provide and receive operating parameters, user instructions or notifications, performance characteristics, user preferences, or any other suitable information for improved performance of washing machine appliance 50. In addition, it should be appreciated that external communication system 180 may be used to transfer data or other information to improve performance of one or more external devices or appliances or improve user interaction with such devices.

For example, external communication system 180 permits controller 200 of washing machine appliance 50 to communicate with a separate device external to washing machine appliance 50, referred to generally herein as a remote or external device 182. As described in more detail below, these communications may be facilitated using a wired or wireless connection, such as via a network 184. In general, external device 182 may be any suitable device separate from washing machine appliance 50 that is configured to provide or receive communications, information, data, or commands from a user. In this regard, external device 182 may be, for example, a personal phone, a smartphone, a tablet, a laptop or personal computer, a wearable device, a smart home system, or another mobile or remote device. In turn, external device 182 may include a monitor or screen 190 configured to display digital two-dimensional images, as would be understood.

Generally, external device 182 may include a controller 188 (e.g., including one or more suitable processing devices, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. Controller 188 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor of controller 188 or may be included onboard within such processor. In addition, these memory devices may store information or data accessible by the one or more processors of the controller 188, including instructions that may be executed by the one or more processors. It should be appreciated that the instructions may be software written in any suitable programming language or may be implemented in hardware. Additionally, or alternatively, the instructions may be executed logically or virtually using separate threads on one or more processors.

For example, controller 188 may be operable to execute programming instructions or micro-control code associated with operation of or engagement with washing machine appliance 50. In this regard, the instructions may be software or any set of instructions that when executed by the processing device, cause the processing device to perform operations, such as running one or more software applications, displaying, or directing a user interface, receiving user input, processing user input, etc. Moreover, it should be noted that controller 188 as disclosed herein is capable of and may be operable to perform one or more methods, method steps, or portions of methods of appliance operation. For example, in some embodiments, these methods may be embodied in programming instructions stored in the memory and executed by controller 188.

The memory devices of controller 188 may also store data that may be retrieved, manipulated, created, or stored by one or more processors or portions of controller 200. The data may include, for instance, data to facilitate performance of methods described herein. Stored data may be retrieved, manipulated, created, or stored by one or more processors or portions of controller 188. The data may include, for instance, data to facilitate performance of methods described herein.

Returning generally to FIG. 1, the data of controller 188 may be stored locally (e.g., on controller 188) in one or more databases or may be split up so that the data is stored in multiple locations. In addition, or alternatively, one or more database(s) may be connected to controller 188 through any suitable network(s), such as through a high bandwidth local area network (LAN) or wide area network (WAN). In this regard, for example, controller 188 may further include a communication module or interface that may be used to communicate with washing machine appliance 50, controller 200, or any other suitable device, e.g., via any suitable communication lines or network(s) and using any suitable communication protocol. The communication interface may include any suitable components for interfacing with one or more network(s), including for example, transmitters, receivers, ports, controllers, antennas, or other suitable components.

Separate from or in addition to external device 182, a remote server 186 may be in communication with washing machine appliance 50 or external device 182 through network 184. In this regard, for example, remote server 186 may be a cloud-based server 186, and is thus located at a distant location, such as in a separate state, country, etc. According to an example embodiment, external device 182 may communicate with a remote server 186 over network 184, such as the Internet, to transmit/receive data or information, provide user inputs, receive user notifications or instructions, interact with or control washing machine appliance 50, etc. In addition, external device 182 and remote server 186 may communicate with washing machine appliance 50 to communicate similar information.

In general, communication between washing machine appliance 50, external device 182, remote server 186, or other user devices or appliances may be carried using any type of wired or wireless connection and using any suitable type of communication network, non-limiting examples of which are provided below. For example, external device 182 may be in direct or indirect communication with washing machine appliance 50 through any suitable wired or wireless communication connections or interfaces, such as network 184. For example, network 184 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), or protection schemes (e.g., VPN, secure HTTP, SSL).

External communication system 180 is described herein according to an example embodiment of the present subject matter. However, it should be appreciated that the example functions and configurations of external communication system 180 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

Wash fluid height sensor 124 is operable to measure the height of wash fluid within tub 64. For example, wash fluid height sensor 124 may be fluidly coupled with tub 64 via a hose 125 that extends between tub 64 and wash fluid height sensor 124. A pressure of air within hose 125 may vary as a function of the height of wash fluid within tub 64, and wash fluid height sensor 124 may be configured for measuring the pressure of air within hose 125. Thus, wash fluid height sensor 124 may be a pressure sensor, and a signal from wash fluid height sensor 124 may vary as a function of the height of wash fluid within tub 64. Controller 200 may receive the signal from wash fluid height sensor 124 to establish the height of wash fluid within tub 64.

Drain hose 86 of washing machine appliance 50 may extend through rear panel mounted bracket 49, and an end of drain hose 86 may be received within a drain standpipe 51. Thus, wash fluid from pump assembly 72 may flow through drain hose 86 into drain standpipe 51. Drain standpipe 51 is a component of a building housing washing machine appliance 50. Thus, a height HS of drain standpipe 51 may vary between buildings. The height HS of drain standpipe 51 may correspond to a vertical distance between a bottom of washing machine appliance 50 (e.g., or rear panel mounted bracket 49) and a top of drain standpipe 51 (e.g., at which drain hose 86 is inserted into drain standpipe 51).

Washing machine appliance 100 must operate in a variety of conditions, e.g., in a user's building. The height HS of the drain standpipe 51 can affect the performance of the washing machine appliance 100. The drain standpipe 51 is commonly positioned at a height HS of about three feet (3') to about five feet (5'). However, in certain instances, the height HS of the drain standpipe 51 may be higher or lower than the common height HS of the drain standpipe 51. For example, users or operators of the washing machine appliance 100 often hook up washing machine appliances to drain standpipes that has a height that is higher or lower than what is common. Accordingly, to avoid performance issues, e.g., when the drain standpipe is set to an uncommon height HS, embodiments of the present subject matter advantageously provide systems and methods, e.g., described in more detail below, that may determine the actual height of the drain standpipe 51. Thus, performance of the washing machine appliance 100 may be analyzed and adjustments or modifications may be made to the operational conditions of the washing machine appliance 100 to ensure reliable operation for the washing machine appliance 100.

Now that the construction of a washing machine appliance, e.g., washing machine appliance 100, and the configuration of a controller, e.g., controller 200, according to exemplary embodiments have been presented, exemplary methods of operating a washing machine appliance will be described. In exemplary embodiments, the various method steps as disclosed herein may be performed by controller or a separate, dedicated controller. Furthermore, some or all of the various method steps may be performed remotely, e.g., in a distributed computing environment such as the cloud, fog, or edge, wherein the controller communicates with one or more remote computing devices of the distributed computing environment, such as processing, may be performed in the cloud and the output of such process may be transmitted to and received by the washing machine appliance, such as by the controller thereof via a communications module.

Now that the construction of washing machine appliance 100 and the configuration of controller 200 according to exemplary embodiments have been presented, an exemplary method 300 of operating a washing machine appliance will be described. Although the discussion below refers to the exemplary method 300 of operating washing machine appliance 100, one skilled in the art will appreciate that the exemplary method 300 is applicable to the operation of a variety of other washing machine appliances. In exemplary embodiments, the various method steps as disclosed herein may be performed by controller 200 or a separate, dedicated controller.

Advantageously, embodiments described herein may provide a washing machine appliance or method for determining an actual height of a drain standpipe connected to a washing machine appliance. Additionally or alternatively, embodiments described herein may generally prevent siphoning or insufficient draining from a portion of a washing machine appliance.

Figure 4:
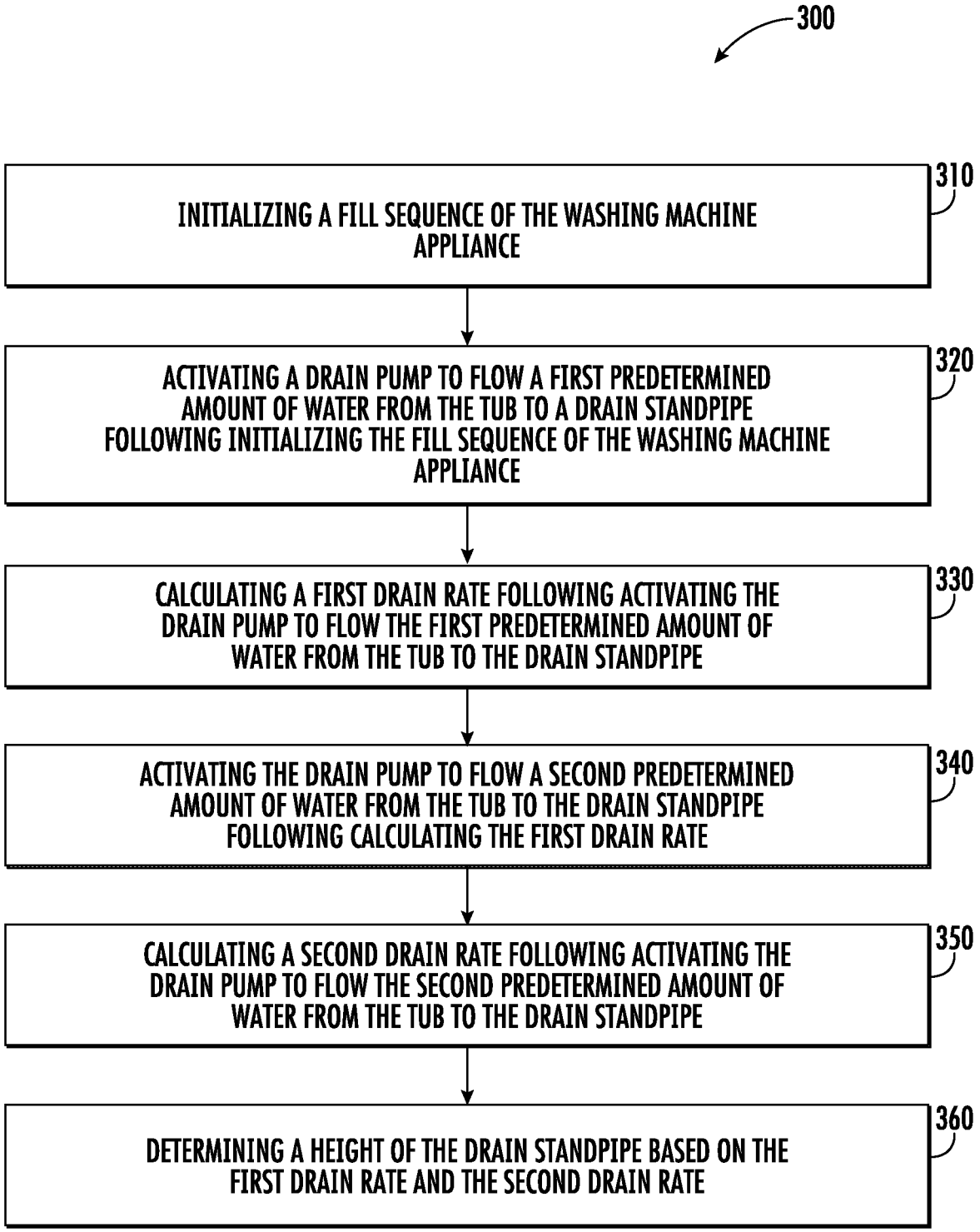
FIG. 4 is a flowchart of a method of operating a washing machine appliance according to one or more exemplary embodiments of the present subject.

Referring now to FIG. 4, at 310, the method 300 includes initializing an operating cycle (e.g., a wash cycle or a rinse cycle) of the washing machine appliance. In some embodiments, initializing the operating cycle of the washing machine appliance includes activating a water supply valve to flow an initial fill of water into a tub of the washing machine appliance. In some embodiments, the initial fill corresponds to an initial water level, e.g., an initial height or an initial volume of water within the tub. The initial water level may be any suitable height or volume of water within the tub. For example, the initial water level may be one foot (1') of water or two cubic feet (2 $ft^3$) of water. The initial fill of water may be dispersed from an inlet tube through a nozzle assembly into the tub. In some embodiments, the initial fill of water is mixed with a wash additive, e.g., detergent, fabric softener, etc., to form a wash additive. In this regard, in instances, the initial fill of water may be an initial fill of wash fluid.

In addition, in some embodiments, initializing the operating cycle of the washing machine appliance further includes receiving a first pressure signal from a pressure sensor associated with the tub following activating the water supply valve to flow the initial fill of water into the tub. The first pressure signal may be indicative of a pressure of the initial fill of water in the tub. In some instances, the initial pressure of the water in the tub may correspond to the initial water level, e.g., the initial height of water or the initial volume of water within the tub. In this regard, the pressure signal may vary as a function of the height or volume of water or wash fluid within the tub.

At 320, the method 300 includes activating a pump assembly to flow a first predetermined depth of water or wash fluid from the tub to a drain standpipe following initializing the operating cycle of the washing machine appliance. In particular, the controller may power a motor to drive a pump within the pump assembly. The pump of the pump assembly may urge water or wash fluid from the tub out of washing machine appliance to drain standpipe. In particular, the pump may flow the water from tub up the height of drain standpipe during operation of pump assembly. In some embodiments, the first predetermined depth of water or wash fluid is based on to the initial water level and a first predetermined water level. In particular, the first predetermined depth of water may equal the difference of water or wash fluid that is between the initial water level and the first predetermined water level. For example, if the initial water level is one foot (1') of water and the first predetermined water level is one inch (1") of water, the first predetermined depth of water may be eleven inches (11") of water.

At 330, the method 300 includes calculating a first drain rate following activating the pump assembly to flow the first predetermined depth of water from the tub to the drain standpipe. In some embodiments, calculating the first drain rate includes receiving a second pressure signal from the pressure sensor indicative of a first drain pressure of water in the tub following activating the pump assembly to flow a first predetermined depth of water from the tub to a drain standpipe. The second pressure signal may be indicative of a pressure of the water in the tub after, e.g., immediately after, the first predetermined depth of water has been drained out of the tub.

In addition, in some embodiments, calculating the first drain rate includes determining a first change in pressure. The first change in pressure may correspond to the change in pressure between the pressure of the initial fill of the water and the pressure of the water after the pump assembly as flowed the first predetermined depth of water from the tub to the drain standpipe. In addition, in some embodiments, calculating the first drain rate includes recording a first drain time needed to flow the first predetermined depth of water from the tub to the drain standpipe. The first drain time may be the measured amount of time that it takes the pump assembly to flow the first predetermined depth of water from the tub to the drain standpipe. The first drain time may be recorded, e.g., stored, within a memory associated with the washing machine appliance. Further, in some embodiments, calculating the first drain rate includes dividing the change in pressure by the first drain time to determine the first drain rate.

At 340, the method 300 includes activating the pump assembly to flow a second predetermined depth of water from the tub to the drain standpipe following calculating the first drain rate. In particular, the controller may power a motor to drive a pump within the pump assembly. The pump of the pump assembly may urge water from tub out of washing machine appliance to drain standpipe. In particular, the pump may flow the water from tub up the height of drain standpipe during operation of pump assembly. In some embodiments, the second predetermined depth of water or wash fluid is based on to the first predetermined water level and a second predetermined water level. In particular, the second predetermined depth of water may equal the difference of water or wash fluid that is between the first predetermined water level and the second predetermined water level. For example, if the first predetermined water level is one inch (1") of water and the second predetermined water level is one tenth of an inch (0.1") of water, the second predetermined depth of water may be nine tenths of an inch (0.9") of water.

At 350, the method 300 includes calculating a second drain rate following activating the pump assembly to flow the second predetermined depth of water from the tub to the drain standpipe. In some embodiments, calculating the second drain rate includes receiving a third pressure signal from the pressure sensor indicative of the pressure of the water in the tub following activating the pump assembly to flow the second predetermined depth of water from the tub to the drain standpipe. The third pressure signal may be indicative of a pressure of the water in the tub after, e.g., immediately after, the second predetermined depth of water has been drained out of the tub.

In some embodiments, at 350, activating the pump assembly to flow the second predetermined depth of water includes continuing to flow of water from the tub to the drain standpipe. For instance, in some embodiments, the pump assembly continuously flows water, for example, between 330 and 350, to flow the first predetermined depth of water and the second predetermined depth of water from the tub to the drain standpipe.

In addition, in some embodiments, calculating the second drain rate includes determining a second change in pressure. The second change in pressure may correspond to the change in pressure between the pressure of the water after the pump assembly as flowed the first predetermined depth of water from the tub to the drain standpipe and the pressure of the water in the tub following activating the pump assembly to flow the second predetermined depth of water from the tub to the drain standpipe pressure. In addition, in some embodiments, calculating the second drain rate includes recording a second drain time needed to flow the second predetermined depth of water from the tub to the drain standpipe. The second drain time may be the measured amount of time that it takes the pump assembly to flow the second predetermined depth of water from the tub to the drain standpipe. The first drain time may be recorded, e.g., stored, within a memory associated with the washing machine appliance. Further, in some embodiments, calculating the second drain rate includes dividing the second change in pressure by the second drain time to determine the second drain rate.

At 360, the method 300 includes determining a height of the drain standpipe based on the first drain rate and the second drain rate. In some embodiments, determining the height of the drain standpipe based on the first drain rate and the second drain rate includes calculating the height of the drain standpipe with a predetermined regression equation stored within a memory associated with the washing machine appliance. According to some exemplary embodiments, the height of the drain standpipe may be calculated with reference to Equation 1. In this regard, A, B, C, D, and E may be fixed coefficients determined empirically or in any other manner. The variable "first drain rate" may refer generally to the first drain rate calculated at 330. The variable "second drain rate" may refer generally to the second drain rate calculated at 350. The variable "starting pressure" may generally refer to the first pressure signal indicative of the pressure of the initial fill of water received at 310.

$$\text{Height of drain stanpipe} = A - B(\text{first drain rate}) - C(\text{second drain rate}) + D(\text{starting pressure}) + E(\text{first drain rate} * \text{second drin rate}) \quad \text{Equation 1}$$

Additionally or alternatively, the method 300 may include comparing the height of the drain standpipe, e.g., determined at 360, to a preset height of the drain standpipe following determining the height of the drain standpipe. In some embodiments, comparing the height of the drain standpipe to the preset height of the drain standpipe includes determining the drain standpipe is outside a threshold range from the preset height of the drain standpipe in response to comparing the height of the drain standpipe to the predetermined height of the drain standpipe. The preset height of the drain standpipe may correspond to a common or recommended drain standpipe height range. For example, the preset height of the drain standpipe may correspond to a drain standpipe height of about three feet (3') to about five feet (5'). The threshold range may correspond to any suitable distance outside of the common or recommended drain standpipe height range. For example, the threshold range may correspond to about half a foot (0.5'), e.g., 6 inches (6"), above or below the preset height of the drain standpipe, such as above five and a half feet (5.5') or below two and a half feet (2.5'). as another example, the threshold range may correspond to about a foot (1') or more, above or below the preset height of the drain standpipe, such as above six feet (6') or below two feet (2').

Additionally or alternatively, the method 300 may include providing a user notification on a user interface display associated with the washing machine appliance following determining the drain standpipe is outside the threshold range from the preset height of the drain standpipe. In particular, in response to determining the drain standpipe is outside the threshold range from the preset height of the drain standpipe, a signal may be transmitted from the controller of the washing machine appliance to a user interface display associated with the washing machine appliance. For example, the signal may be transmitted to the display of the washing machine appliance or to a remote user interface display of an external device associated with the washing machine appliance. The signal transmitted may include a user alert that may be displayed on the user interface display associated with the washing machine appliance that indicates that the drain standpipe height is outside a threshold distance from the predetermined height.

Additionally or alternatively, in some embodiments, operation of washing machine appliance may be adjusted in response to the determining the height of the drain standpipe is outside the threshold range from the preset height of the drain standpipe. As an example, the controller may be configured to adjust operation of washing machine appliance by one or more of modifying a drain profile of pump assembly, modifying a spin profile of basket during a spin cycle, or modifying a rinse profile during a rinse cycle when the height of drain standpipe is the low drain rate. In particular, controller may be configured to extending the spin cycle, decreasing a rotational speed or acceleration of basket during the spin cycle, or conducting an additional rinse cycle or a different rinse cycle, such as a warm rinse or a deep rinse, in response to the determined height of drain standpipe. In particular, when the height HS of drain standpipe is greater than a normal drain standpipe height (e.g., and pump assembly takes longer to drain the tub), controller may adjust operation of washing machine appliance by one or more of modifying the drain profile of pump assembly, modifying the spin profile of basket during the spin cycle, and modifying the rinse profile during the rinse cycle to allow additional draining of tub or prevent excessive soap suds formation within tub.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a washing machine appliance comprising a tub, a basket within the tub and a pump assembly operable to flow wash fluid from the tub, the method comprising:

initializing an operating cycle of the washing machine appliance;

activating the pump assembly to flow a first predetermined depth of water from the tub to a drain standpipe following initializing the operating cycle of the washing machine appliance;

calculating a first drain rate following activating the pump assembly to flow the first predetermined depth of water from the tub to the drain standpipe;

activating the pump assembly to flow a second predetermined depth of water from the tub to the drain standpipe following calculating the first drain rate, wherein the first predetermined depth of water is different than the second predetermined depth of water;

calculating a second drain rate following activating the pump assembly to flow the second predetermined depth of water from the tub to the drain standpipe;

determining a height of the drain standpipe based on the first drain rate and the second drain rate; and adjusting the operating cycle of the washing machine appliance in response to determining the height of the drain standpipe based on the first drain rate and the second drain rate, wherein adjusting the operating cycling comprises modifying a drain profile of the pump assembly during the operating cycle.

2. The method of claim 1, wherein initializing the operating cycle of the washing machine appliance comprises activating a water supply valve to flow an initial fill of water into a tub of the washing machine appliance.

3. The method of claim 2, wherein initializing the operating cycle of the washing machine appliance further comprises receiving a first pressure signal from a pressure sensor associated with the tub indicative of an initial pressure of the water in the tub following activating the water supply valve to flow the initial fill of water into the tub of the washing machine appliance.

4. The method of claim 3, wherein calculating the first drain rate comprises receiving a second pressure signal from the pressure sensor indicative of the pressure of water in the tub following activating the pump assembly to flow a first predetermined depth of water from the tub to a drain standpipe, determining a first change in pressure between the initial pressure of the water in the tub and the pressure of the water in the tub following activating the pump assembly to flow the first predetermined depth of water from the tub to the drain standpipe, recording a first drain time to flow the first predetermined depth of water from the tub to the drain standpipe, and dividing the first change in pressure by the first drain time.

5. The method of claim 4, wherein calculating the second drain rate comprises receiving a third pressure signal from the pressure sensor indicative of a second drain pressure of the water in the tub following activating the pump assembly to flow the second predetermined depth of water from the tub to the drain standpipe, determining a second change in pressure between the pressure of the water in the tub following activating the pump assembly to flow the first predetermined depth of water from the tub to the drain standpipe and the pressure of the water in the tub following activating the pump assembly to flow the second predetermined depth of water from the tub to the drain standpipe, recording a second drain time to flow the second predetermined depth of water from the tub to the drain standpipe, and dividing the second change in pressure by the second drain time.

6. The method of claim 1, wherein determining the height of the drain standpipe based on the first drain rate and the second drain rate comprises calculating the height of the drain standpipe according to a predetermined regression equation stored within a memory associated with the washing machine appliance.

7. The method of claim 1, further comprising:

comparing the height of the drain standpipe to a preset height of the drain standpipe following determining the height of the drain standpipe.

8. The method of claim 7, wherein comparing the height of the drain standpipe to a preset height of the drain standpipe comprises determining the height of the drain standpipe is outside a threshold range from the preset height of the drain standpipe in response to comparing the height of the drain standpipe to the preset height of the drain standpipe.

9. The method of claim 8, further comprising:

providing a user notification on a user interface display associated with the washing machine appliance in response to determining the height of the drain standpipe is outside the threshold range from the preset height of the drain standpipe, wherein the user notification comprises a user alert indicating that the height of the drain standpipe is outside a threshold range from the preset height of the drain standpipe.

10. The method of claim 8, wherein adjusting the operating cycle of the washing machine appliance is in response to determining the height of the drain standpipe is outside the threshold range from the preset height of the drain standpipe.

11. A washing machine appliance comprising:

a tub;

a basket within the tub;

a pump assembly operable to flow wash fluid from the tub;

a controller in operative communication with the pump assembly, the controller configured to store instruction, that when executed, causes the controller to execute operations, the operations comprising:

initializing an operating cycle of the washing machine appliance;

activating the pump assembly to flow a first predetermined depth of water from the tub to a drain standpipe following initializing the operating cycle of the washing machine appliance;

calculating a first drain rate following activating the pump assembly to flow the first predetermined depth of water from the tub to the drain standpipe;

activating the pump assembly to flow a second predetermined depth of water from the tub to the drain standpipe following calculating the first drain rate, wherein the first predetermined depth of water is different than the second predetermined depth of water;

calculating a second drain rate following activating the pump assembly to flow the second predetermined depth of water from the tub to the drain standpipe;

determining a height of the drain standpipe based on the first drain rate and the second drain rate; and adjusting the operating cycle of the washing machine appliance in response to determining the height of the drain standpipe based on the first drain rate and the second drain rate, wherein adjusting the operating cycling comprises modifying a drain profile of the pump assembly during the operating cycle.

12. The washing machine appliance of claim 11, wherein initializing the operating cycle of the washing machine appliance comprises activating a water supply valve to flow an initial fill of water into a tub of the washing machine appliance.

13. The washing machine appliance of claim 12, wherein initializing the operating cycle of the washing machine appliance further comprises receiving a first pressure signal from a pressure sensor associated with the tub indicative of an initial pressure of the water in the tub following activating the water supply valve to flow the initial fill of water into the tub of the washing machine appliance.

14. The washing machine appliance of claim 13, wherein calculating the first drain rate comprises receiving a second pressure signal from the pressure sensor indicative of the pressure of water in the tub following activating the pump assembly to flow a first predetermined depth of water from the tub to a drain standpipe, determining a first change in pressure between the initial pressure of the water in the tub and the pressure of the water in the tub following activating the pump assembly to flow the first predetermined depth of water from the tub to the drain standpipe, recording a first drain time to flow the first predetermined depth of water from the tub to the drain standpipe, and dividing the first change in pressure by the first drain time.

15. The washing machine appliance of claim 14, wherein calculating the second drain rate comprises receiving a third pressure signal from the pressure sensor indicative of a second drain pressure of the water in the tub following activating the pump assembly to flow the second predetermined depth of water from the tub to the drain standpipe, determining a second change in pressure between the pressure of the water in the tub following activating the pump assembly to flow the first predetermined depth of water from the tub to the drain standpipe and the pressure of the water in the tub following activating the pump assembly to flow the second predetermined depth of water from the tub to the drain standpipe, recording a second drain time to flow the second predetermined depth of water from the tub to the drain standpipe, and dividing the second change in pressure by the second drain time.

16. The washing machine appliance of claim 11, wherein determining the height of the drain standpipe based on the first drain rate and the second drain rate comprises calculating the height of the drain standpipe according to a predetermined regression equation stored within a memory associated with the washing machine appliance.

17. The washing machine appliance of claim 11, further comprising:

comparing the height of the drain standpipe to a preset height of the drain standpipe following determining the height of the drain standpipe.

18. The washing machine appliance of claim 17, wherein comparing the height of the drain standpipe to a preset height of the drain standpipe comprises determining the height of the drain standpipe is outside a threshold range from the preset height of the drain standpipe in response to comparing the height of the drain standpipe to the preset height of the drain standpipe.

19. The washing machine appliance of claim 18, further comprising:

providing a user notification on a user interface display associated with the washing machine appliance in response to determining the height of the drain standpipe is outside the threshold range from the preset height of the drain standpipe, wherein the user notification comprises a user alert indicating that the height of the drain standpipe is outside a threshold range from the preset height of the drain standpipe.

20. The washing machine appliance of claim 18, wherein adjusting the operating cycle of the washing machine appliance is in response to determining the height of the drain standpipe is outside the threshold range from the preset height of the drain standpipe.

* * * * *